US008534368B2

(12) United States Patent
Reimert et al.

(10) Patent No.: US 8,534,368 B2
(45) Date of Patent: Sep. 17, 2013

(54) DOWNHOLE TOOL WITH SLIP RELEASING MECHANISM

(75) Inventors: Larry E. Reimert, Houston, TX (US); John M. Yokley, Kingwood, TX (US)

(73) Assignee: Dril-Quip, Inc., Houston, TX (US)

( * ) Notice: Subject to any disclaimer, the term of this patent is extended or adjusted under 35 U.S.C. 154(b) by 661 days.

(21) Appl. No.: 12/514,169

(22) PCT Filed: Nov. 15, 2007

(86) PCT No.: PCT/US2007/023792

§ 371 (c)(1),
(2), (4) Date: May 8, 2009

(87) PCT Pub. No.: WO2008/076189

PCT Pub. Date: Jun. 26, 2008

(65) Prior Publication Data

US 2010/0038096 A1 Feb. 18, 2010

Related U.S. Application Data

(60) Provisional application No. 60/859,140, filed on Nov. 15, 2006.

(51) Int. Cl.
*E21B 23/00* (2006.01)

(52) U.S. Cl.
USPC ..... 166/382; 166/208; 166/212

(58) Field of Classification Search
USPC ..... 166/212, 382, 318, 120, 387, 208, 166/386
See application file for complete search history.

(56) References Cited

U.S. PATENT DOCUMENTS

| | | | | |
|---|---|---|---|---|
| 2,315,931 | A * | 4/1943 | Burt et al. | 166/122 |
| 2,328,840 | A * | 9/1943 | O'Leary | 166/208 |
| 3,920,057 | A | 11/1975 | Hamilton et al. | |
| 4,281,711 | A | 8/1981 | Braddick et al. | |
| 4,287,949 | A | 9/1981 | Lindsey, Jr. | |
| 4,311,194 | A | 1/1982 | White | |
| 4,603,743 | A | 8/1986 | Lindsey, Jr. | |
| 4,712,614 | A | 12/1987 | Allwin et al. | |
| 5,318,131 | A | 6/1994 | Baker | |
| 5,332,045 | A * | 7/1994 | Ross et al. | 166/387 |
| 6,739,398 | B1 | 5/2004 | Yokley et al. | |

* cited by examiner

*Primary Examiner* — Kenneth L Thompson
(74) *Attorney, Agent, or Firm* — Baker Botts L.L.P.

(57) ABSTRACT

A downhole tool includes a lock for maintaining a slip in a reduced diameter position when running the tool in the well, and selectively releases the slip to move radially outward to a set position to suspend an anchored portion of the tool within a downhole tubular. The tool includes a mandrel having a through passage, with a hydraulic port within the mandrel that is closed to mandrel internal pressure as the tool is run in the wellbore. A ball seat covers hydraulic ports in the mandrel. A ball may be dropped to seat and increase pressure to open the ports. A piston moves in response to mandrel internal pressure applied through the hydraulic port to unlock the locking device, such that further movement of the piston releases the slip from the reduced diameter position to the set position.

24 Claims, 12 Drawing Sheets

DOWNHOLE TOOL WITH SLIP RELEASING MECHANISM

CROSS REFERENCE TO RELATED APPLICATION

This application claims the priority of U.S. Provisional Application No. 60/859,140 filed on Nov. 15, 2006, the disclosure of which is incorporated herein by reference for all purposes.

FIELD OF THE INVENTION

The present invention relates to downhole tools for anchoring a portion of the tool in a well. More particularly, the present invention relates to a downhole tool such as a liner hanger assembly for hanging a liner in a well, and to an improved slip releasing mechanism within the downhole tool.

BACKGROUND OF THE INVENTION

Various types of downhole tools employ slips which expand radially outward to engage the interior of a downhole tubular, thereby securing the tool in the well. Various types of slip mechanisms have been used for this purpose, with slips conventionally having outer teeth which bite into the inner surface of the downhole tubular to secure the tool in the well.

One of the significant problems with downhole tools having slip mechanisms is that the slip mechanism may be inadvertently actuated before actuation is intended, in which case the slip or slips may radially expand and engage the tubular. It may then be difficult or practically impossible in some instances to break the connection between the downhole tool and the tubular, and accordingly the tool cannot be easily retrieved to the surface, repaired, and then again reinserted into the well. In other instances, the slip may be expanded when the tool is at a desired downhole position, but the running tool/set tool connection cannot be reliably released, so that the retrievable portion of the tool cannot be returned to the surface.

U.S. Pat. Nos. 3,920,057 and 4,281,711 disclose a liner hanger assembly for hanging a liner in a well. A liner hanger assembly is also disclosed in U.S. Pat. No. 6,739,398. The '398 patent discloses a tool that relies upon shear pins to keep the slips from prematurely releasing while the tool is run in the hole. While pushing on the running tool may not release the slip accidentally, if debris were to build up around the tieback or other components of the liner hanger and the operator then pushed or pulled on the tool, the shear pins may shear and thereby release the slip. Tools that allow axial forces to be transmitted to the tool through the running string to shear pins and release the slip may thus inadvertently be actuated when running the tool to the desired depth in the well.

U.S. Pat. Nos. 4,712,614, 4,603,743, 4,311,194 and 4,287,949 also rely on shear pins to keep from releasing the slips. U.S. Pat. No. 5,318,131 is another example of the downhole tool using shear pins to prevent release of slips. Downhole tools with shear pins to keep the slip in the retracted position while running the tool in the hole generally have exposed hydraulic actuation ports. If debris builds up around the tool while tripping into the hole, the dragging action could shear the pins, in which case the slip will set and thereby prevent the tool from being positioned at its desired location in the well. Increased hydraulic pressure may also cause the pins to prematurely shear.

The disadvantages of the prior art are overcome by the present invention, and a liner hanger with an improved slip releasing mechanism is hereinafter disclosed.

SUMMARY OF THE INVENTION

According to one embodiment, a running tool for releasing a slip and preventing premature activation of the slip includes a tool mandrel supported on a running string, and a blocking member for closing off a port in the mandrel when the tool is run in the well and for selectively opening the port to set the slip. A locking member prevents premature setting of the slip, with the locking member being axially securable to the mandrel when the running tool is run in the well. An actuating piston is moveable with respect to the tool mandrel when the port is open to move the locking member and release the slip to set in the well.

The running tool may lock the slip in a reduced diameter position when running the tool into the wellbore and selectively releases the slip to move radially outward to a set position for suspending a downhole tool in a tubular. The running tool includes a mandrel having a through passage, and a locking device supported on the mandrel for retaining the slip in the reduced diameter position when running the tool into the well. A hydraulic port in the mandrel is closed to mandrel internal pressure as the downhole tool is run into the wellbore, and is selectively open when desired. A piston is moveable in response to mandrel internal pressure applied through the hydraulic port to unlock the locking device. Further movement of the piston may release the slip from the reduced diameter position to the set position. Still further movement of the piston may disengage the running tool from the downhole tool, so that the running tool may be retrieved to the surface while the downhole tool is set in the well.

These and further features and advantages of the present invention will become apparent from the following detailed description, wherein reference is made to the figures in the accompanying drawings.

DETAILED DESCRIPTION OF PREFERRED EMBODIMENTS

Figure 1A:
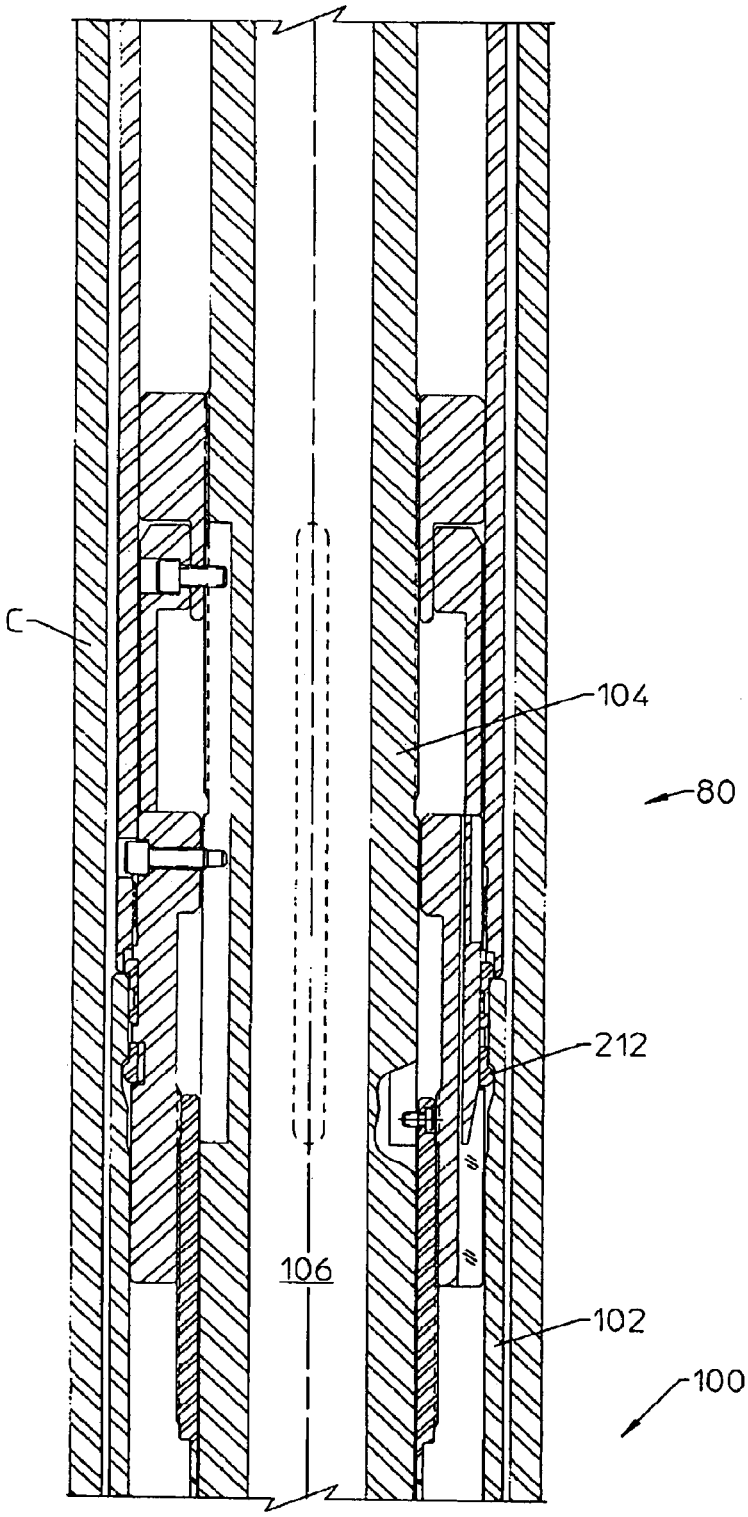
FIGS. 1A through 1G illustrate sequentially the primary components of a suitable liner hanger running tool.
Figure 1B:
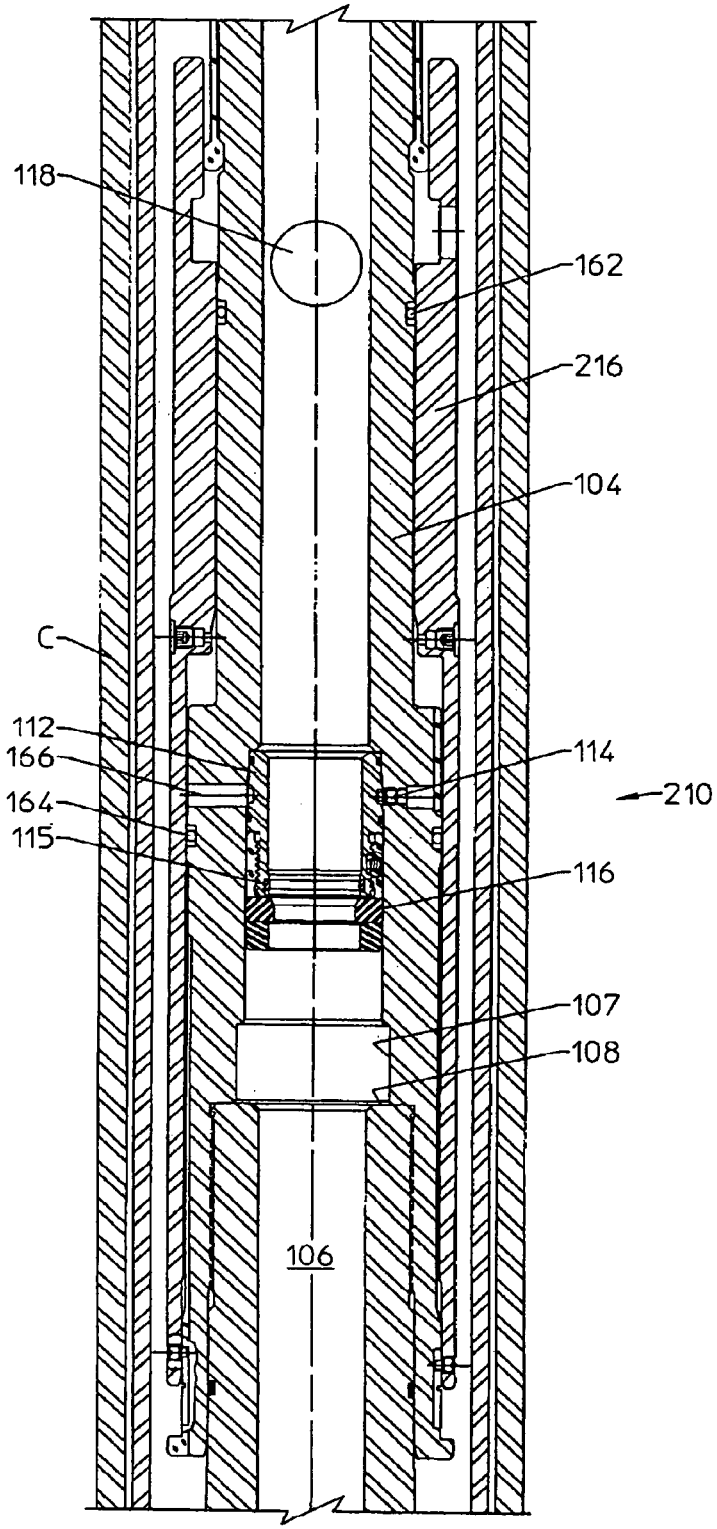
Figure 1C:
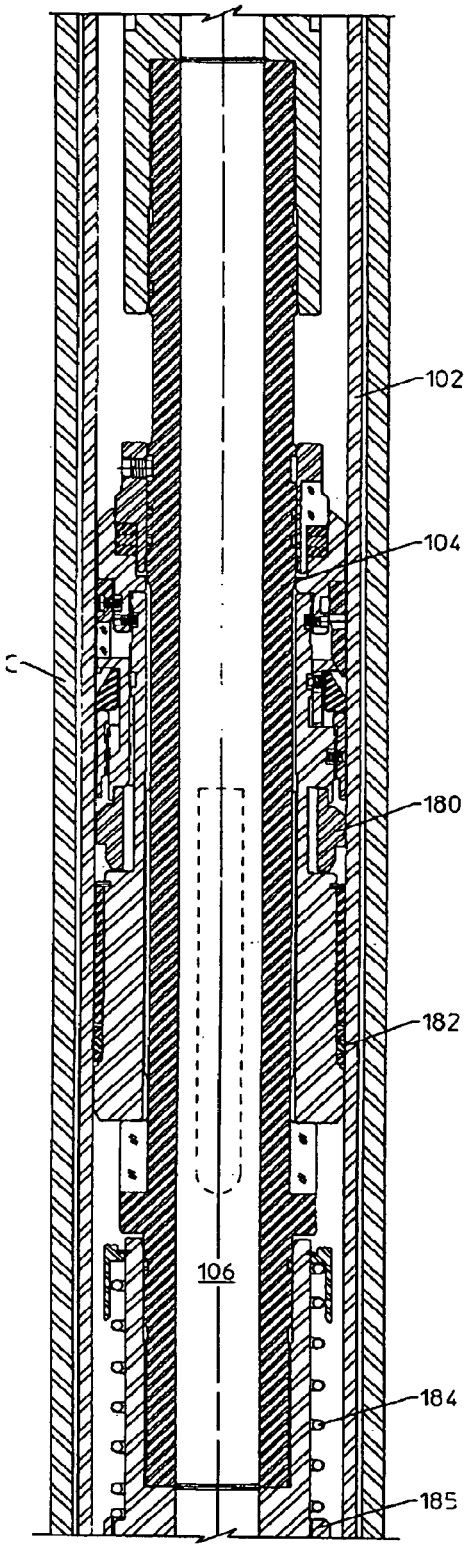
Figure 1D:
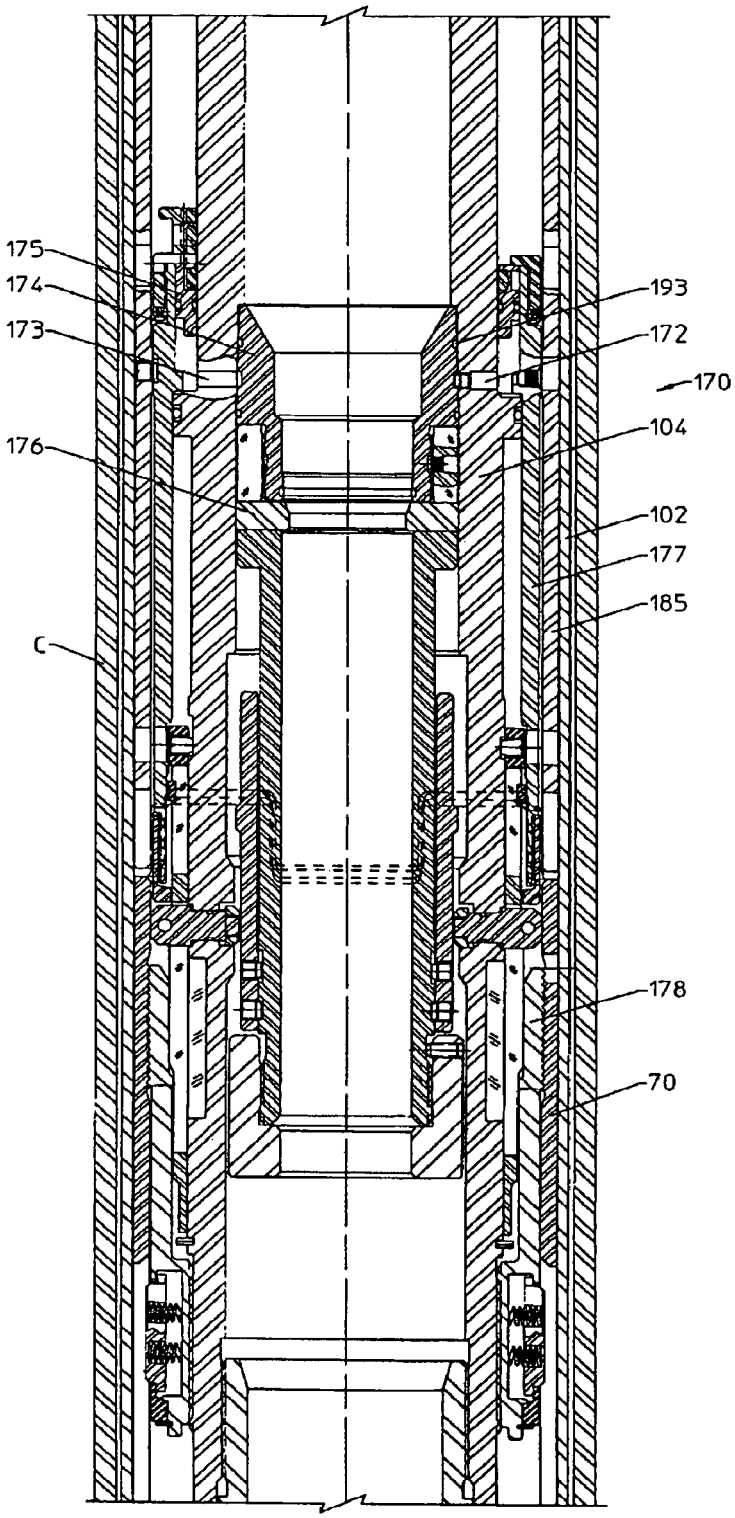
Figure 1E:
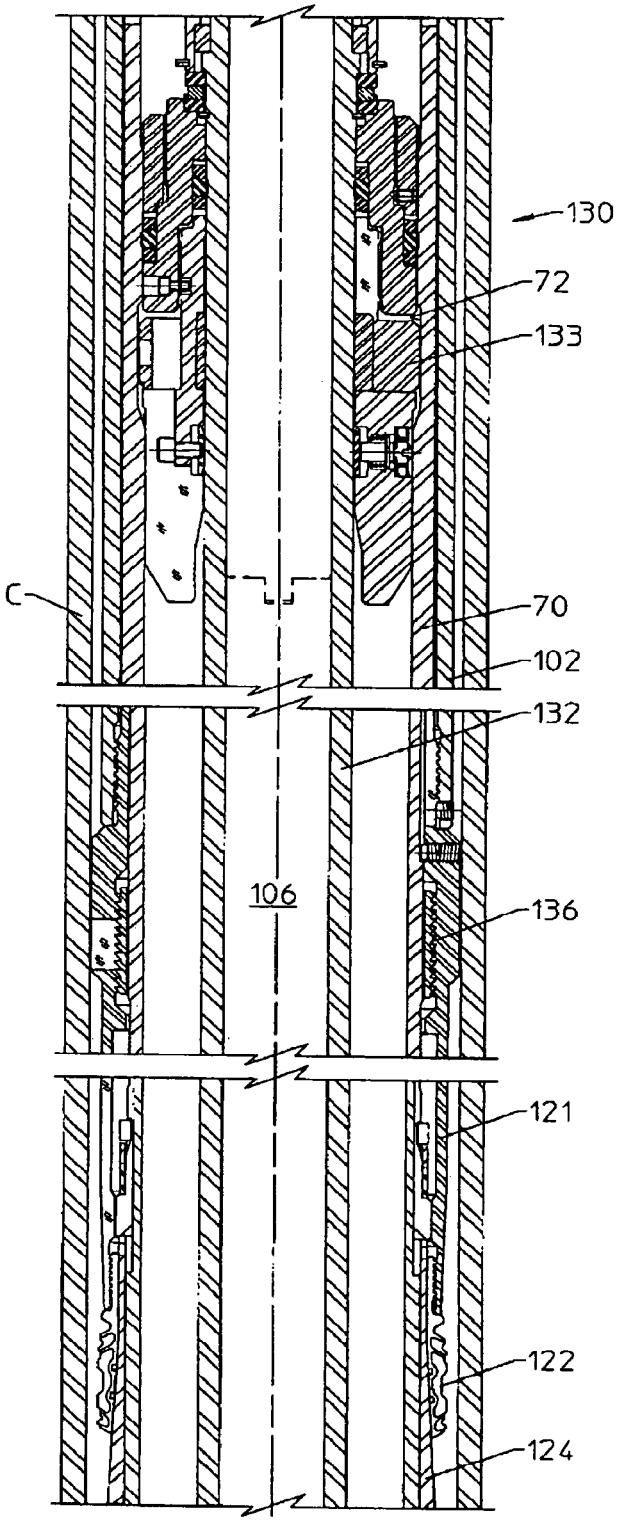
Figure 1F:
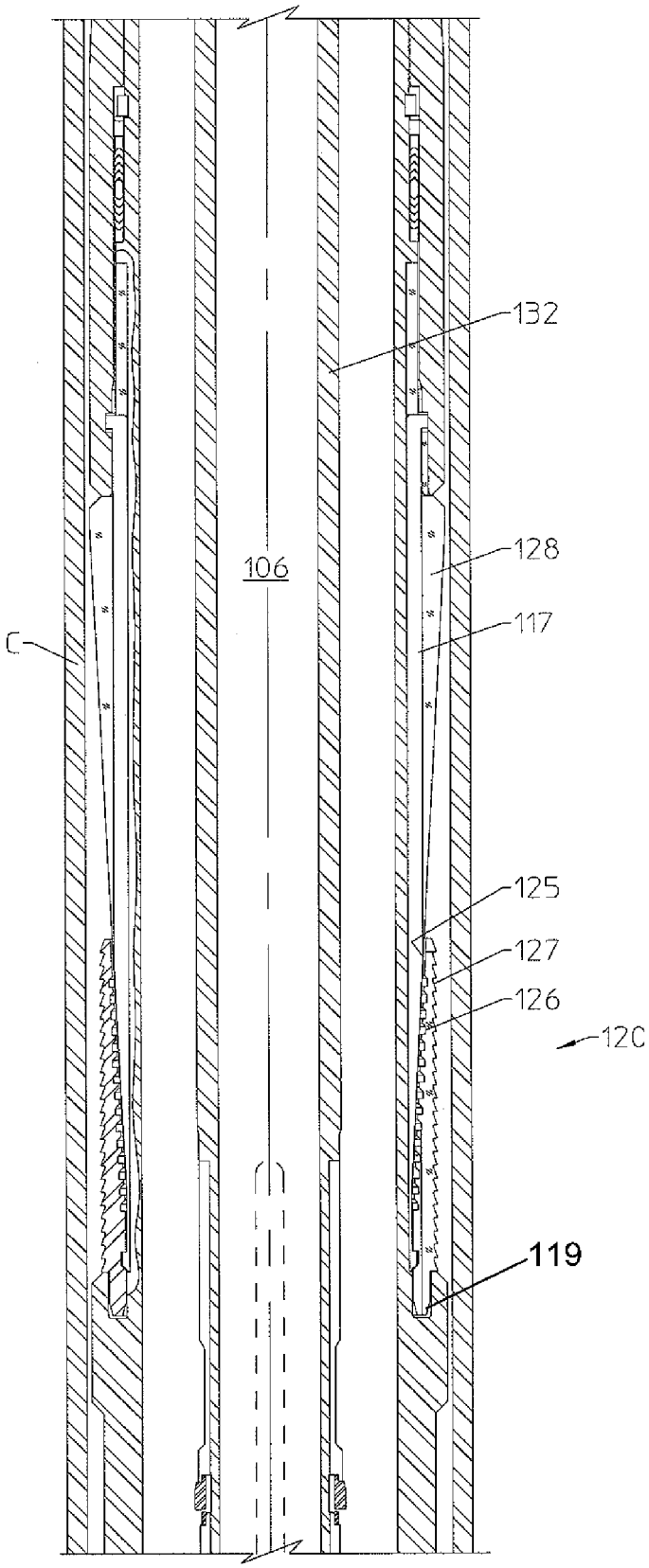
Figure 1G:
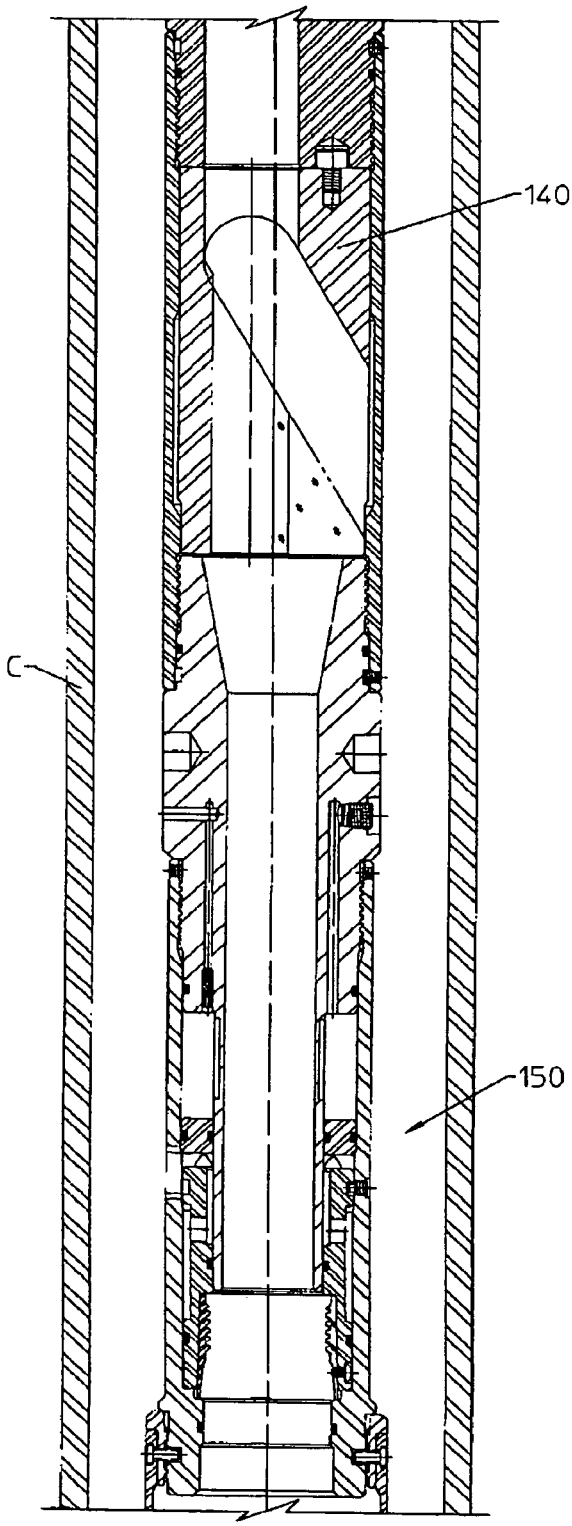

FIG. 1, which consists of FIGS. 1A-1G, illustrates one embodiment of a liner hanger running tool 100 including a running tool tieback locking mechanism 80 (FIG. 1A), a slip release assembly (FIG. 1B) operatively responsive to the upper C-ring seat assembly 110, packer setting lugs 180 (FIG. 1C), a liner hanger release assembly 170 operatively responsive to the lower C-ring seat assembly (FIG. 1D), a cementing bushing 130 (FIG. 1E), and a ball diverter 140 and plug release assembly 150 (FIG. 1G). FIG. 1E illustrates the packer 122 and FIG. 1F illustrates the slip assembly 120, which are not part of the running tool retrieved to the surface, and remain downhole with the set liner.

To hang off a liner, the running tool 100 is initially attached to the lower end of a work string and releasably connected to the liner hanger, from which the liner is suspended for lowering into the bore hole within the previously set casing or liner C.

A tieback receptacle 102 as shown in FIG. 1A is supported about the running tool 100. The upper end of the tieback receptacle 102, upon removal of the running tool, provides for a casing tieback (not shown) to subsequently extend from its upper end to the surface. The tool 100 includes a central mandrel 104, which may comprise multiple connected sections, with a central bore 106 in the mandrel. The lower end of the tieback receptacle 102 is connected to the packer element pusher sleeve 121, as shown in FIG. 1E, whose function will be described in connection with the setting of the packer element 122 about an upper cone 124, as well as setting of the slips 126 about a lower cone 128 (see FIG. 1F).

By incorporating an axially movable slick joint 132 (which may functionally be an extension of the mandrel 104), the running tool may be axially moved without breaking the seal provided by the cementing bushing 130 (see FIG. 1E). The running tool 100 also includes a ball diverter 140 (see FIG. 1G) at the lower end of the running tool. The cementing bushing 130 provides a retrievable and re-stabbable seal between the running tool 100 and the liner hanger assembly for fluid circulation purposes.

FIG. 1A also illustrates a tieback locking and releasing mechanism, which locks the tieback 102 to the running tool mandrel 104 to prevent premature actuation of the liner hanger or downhole portion of the tool as it is run in the well. The locking mechanism unlocks the tieback 102 to allow the slips 126 to be set and the retrievable portion of the tool to be returned to the surface.

Figure 2:
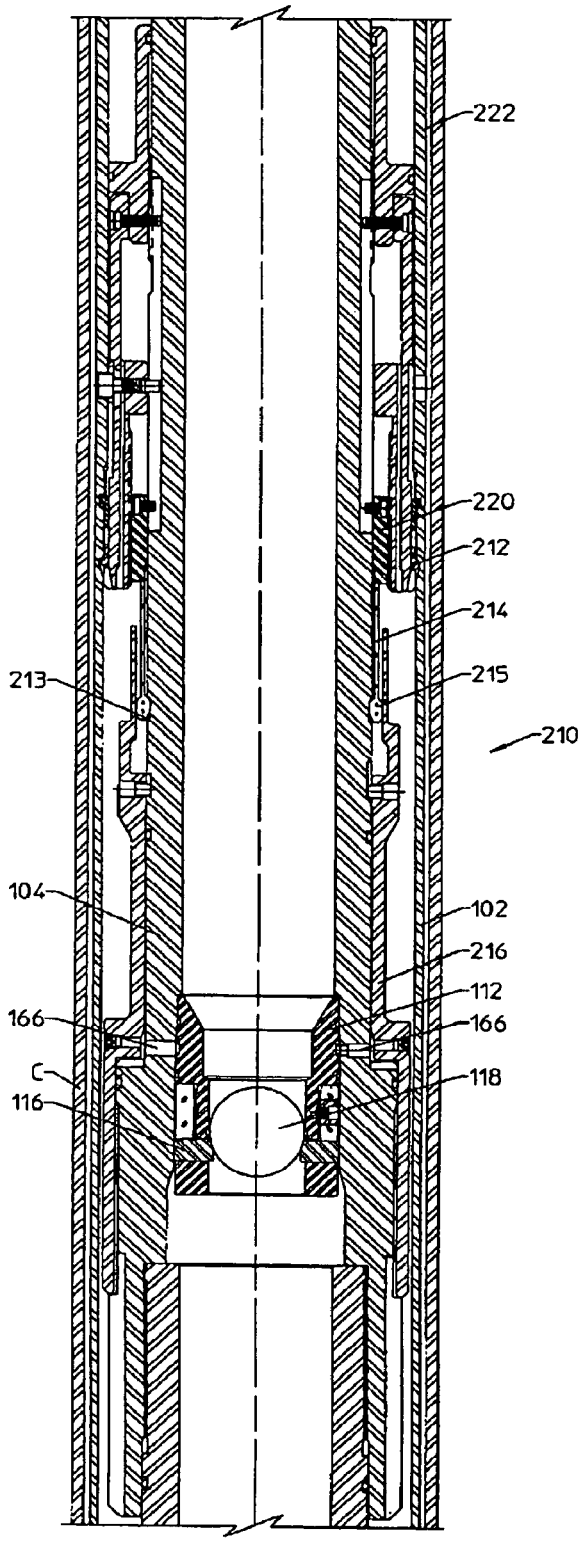
FIG. 2 illustrates in greater detail the cross-sectional view of a slip releasing mechanism generally shown in FIG. 1B.

The slip release subassembly 210 as shown in FIG. 1B, and more particularly in FIG. 2, is used to release the liner hanger slip for setting, and includes a sleeve 112 disposed within and axially moveable relative to the running tool mandrel 104. A C-ring ball seat 116 is supported on the sleeve 112. A seal 115 is provided for sealing with the seated ball. A ball 118 may thus be dropped from the surface into the running tool bore 106 and onto the seat 116. An increase in fluid pressure within the mandrel 104 above the seated ball will shear the pins 114 and lower the ball seat 116 and sleeve 112 to a lower position in the bore of the running tool, e.g., against the stop shoulder 108. Once the sleeve 112 is lowered, fluid pressure may subsequently pass through ports 166 to stroke a piston and thereby release the slips for subsequent setting.

Piston sleeve 216 is disposed about and is axially moveable relative to mandrel 104. An upper sealing ring 162 is disposed about a smaller O.D. of the running tool mandrel than is the lower sealing ring 164 to form an annular pressure chamber between them for lifting the tieback receptacle 102 from the position shown in FIG. 1B to an upper position for setting the slip or slip segments 126. Ports 166 formed in the running tool mandrel 104 connect the running tool bore with the surrounding pressure chamber once the seat 116 and sleeve 112 are lowered. An increase in pressure through the ports 166 will raise the piston sleeve 216. Upward movement of the piston sleeve 216 causes its upper end to raise the tieback receptacle 102, and also raise the slips 126.

The slip 120 shown in FIG. 1F is made up of arcuate slip segments 126 received within circumferentially spaced recesses in slip body sleeve about the lower end of the liner hanger and adjacent the lower cone 128. Each slip segment 126 includes a relatively long tapered arcuate slip having teeth 127 on its outer side and an arcuate cone surface 125 mounted on its inner side for sliding engagement with lower cone 128. When multiple circumferentially spaced slip segments are used, each of the multiple recesses may include a slot in each side. Alternatively, a one piece C-slip may be used to replace the slip segments. The teeth 127 are adapted to bite into the casing C as the liner weight is applied to the slip. The slips 126 are thus movable vertically between a lower retracted position, wherein their outer teeth 127 are spaced from the casing C, and an upper position, wherein the slips 126 have moved vertically over the cone 128 and into engagement with the casing C.

FIGS. 1E and 1F show the relationship of both the packer element 122 and the circumferentially spaced slips 126 about the upper 124 and lower 128 cones, respectively. The annular packer element 122 is disposed about a downwardly-enlarged upper cone 124 beneath the pusher sleeve 121. The packer element 122 is originally of a circumference in which its O.D. is reduced and thus spaced from the casing C. However, the packer element 122 is expandable as it is pushed downwardly over the cone 124 to seal against the casing.

FIG. 1E generally illustrates the cementing bushing 130. The cementing bushing provides a retrievable and re-stabbable seal between the running tool and the liner hanger for fluid circulation purposes prior to cementing, and also for the cementing operation. The cementing bushing 130 cooperates with the slick joint 132 to allow axial movement of the running tool without breaking the seal provided by the cementing bushing. The mandrel 104 of the released running tool can be used to raise the cementing bushing 130 to cause the lugs 133 to move in and unlock from the liner hanger. The liner hanger 70 is shown with an annular groove 72 for receiving the lugs 133. The cementing bushing 130 seals between a radially outward liner running adapter of the liner hanger and a radially inward running tool mandrel.

Ratchet ring 136 is also shown in FIG. 1E. This ratchet ring allows the packer element 122 to be pushed downward over the upper cone 124, then locks the packer element in its set position.

The packer element 122 may be set by using spring-biased pusher C-ring 180 (see FIG. 1C) which, when moved upwardly out of the tieback receptacle 102, will be forced to an expanded position to engage the top of the tieback receptacle. The released running tool may be picked up until the packer setting subassembly is removed from the top of a tieback receptacle, so that the pusher C-ring 180 is raised to a position above the top of the tieback receptacle and expanded outward. When the packer setting assembly is in this expanded position, weight may be slacked off by engaging the pusher C-ring 180 to the top of the tieback 102, which then causes the packer element 122 to begin its downward sealing sequence. When weight is set down, the expanded pusher C-ring 180 transmits this downward force through the tieback receptacle 102 to the pusher sleeve 121, and then the packer element 122 (see FIG. 1E). A sealing ring 182 is shown in FIG. 1C between the packer setting assembly and the tieback receptacle to aid in setting the packer element with annulus pressure assist. The lower portion of FIG. 1C illustrates the upper portion of a clutch 185 splined to the OD of the running tool mandrel 104 to transmit torque while allowing axial movement between the clutch and the mandrel to disengage or reengage the clutch from the hanger. The central portion of the clutch 185 is shown in FIG. 1D, and may move in response to biasing spring 184.

The first time the packer setting assembly is moved out of the polished bore receptacle, a trip ring may snap to a radially outward position. When the packer setting assembly is subsequently reinserted into the polished bore receptacle, the trip ring will engage the top of the polished bore receptacle, and the packer setting C-ring is positioned within the polished bore receptacle. When set down force is applied, the trip ring will move radially inward due to camming action. The entire packer setting assembly may thus be lowered to bottom out on a lower portion of the running adapter prior to initiating the cementing operation. The next time the packer setting assembly is raised out of the polished bore receptacle, the radially outward biasing force of the C-ring will cause the C-ring to engage the top of the tieback. Further details regarding the packer seating assembly are disclosed in U.S. Pat. No. 6,739,398, hereby incorporated by reference.

The packer element 122 may be of a construction as described in U.S. Pat. No. 6,666,276, hereby incorporated by reference, comprising an inner metal body for sliding over the cone and annular flanges or ribs which extend outwardly from the body to engage the casing. Rings of resilient sealing material may be mounted between such ribs. The seal bodies may be formed of a material having substantial elasticity to span the annulus between the liner hanger and the casing C.

The packer setting assembly thus allows the C-ring to be locked in a collapsed position by a locking mechanism to prevent the C-ring from moving to its expanded position. As discussed above, this allows the packer setting assembly to be pulled out of the tie back receptacle one time without releasing the C-ring, and allows the lockout mechanism to engage the top of the tie back receptacle for weight set down. The next time the packer assembly is pulled out of the tie back receptacle, the C-ring is allowed to expand radially outward for engagement with the top of the tie back receptacle.

The C-ring seat subassembly 170 as shown in FIG. 1D may be disposed beneath the upper C-ring seat subassembly 110 shown in FIG. 1B. The lower C-ring seat subassembly 170 is secured within the running tool bore by shear pins 172. Sleeve 174 thus supports seat 176. The ball 118 may first land on the upper seat 116 as shown in FIG. 1B, and once the ball is released from the upper seat it will land on the lower seat 176, as shown in FIG. 1D. Once the ball is seated on the lower seat, a predetermined pressure may be applied to shear pins 172 and move the ball seat 176 and the sleeve 174 downward to uncover the ports 173. This increased pressure may move the piston sleeve 177 to release the slip. Higher fluid pressure may then be applied to cause the piston sleeve 177 to move further upward and thereby disengage the running tool from the set liner hanger. Assembly 170 releases the retrievable portion of the tool to be returned to the surface from the downhole portion of the tool and the set liner. Upon raising of the inner piston 177, the running tool may be raised from the set liner hanger, but prior to setting of the packer, thus releasing the ball and permitting circulation of cement downwardly through the tool and upwardly within the annulus between the liner and casing.

FIG. 1D also illustrates a hydrostatic balance piston 175 for balancing fluid pressure across the seal 193 to increase high reliability for the operation of sleeve 174. Seals 193 above and below port 173 are thus subjected to substantially the same fluid pressure on both sides of the seals, thereby enhancing operation of the sleeve 174. FIG. 1D also illustrates C-ring 178 for gripping the liner hanger 70. The C-ring may be moved radially to position so that it may contract radially inward, thereby releasing the running tool from the liner hanger.

FIG. 1G illustrates a lower portion of the tool, including a ball diverter 140 and a liner wiper plug release assembly 150. The assembly 150 replaces the need for shear screws to secure the liner wiper plug to the running tool. The plug holder shown in FIG. 1G is functionally similar to the plug release assembly disclosed in U.S. Pat. No. 6,712,152, hereby incorporated by reference. Tool components and operations not detailed herein may be functionally similar to the components and operations discussed in U.S. Pat. No. 6,681,860 or U.S. Pat. No. 6,739,398, each hereby incorporated by reference.

After activating the lower C-ring seat subassembly 170 (see FIG. 1D), the operator may lift up the tool to pass the ball through seat 176. A drop in pressure will indicate that the ball has passed through the ball seat, allowing circulation through the running string to continue, and the ball to be pumped downwardly into the ball diverter. Fluids are then circulated through the tool awaiting cement displacement. Cement is then injected through the running tool, and a pump down plug (PDP) follows the cement. The PDP enters the liner wiper plug and forms a barrier to the previously displaced cement and the displacement fluid.

The slip or slips are kept from prematurely setting as the running tool and slip are run into the wellbore by a locking member. FIG. 2 shows the slip releasing mechanism 210 in the run in position. The ports 166 are isolated by the ball sleeve 112, so that fluid pressure within the string and thus within the interior of the mandrel 104 cannot move the slip releasing piston 216 axially upward to release the slip. The locking sleeve or collar 220 with collet heads 215 functions as a slip locking device and is designed to keep the piston 216 and the tieback receptacle 102 from being able to move up while running the tool into the hole, thereby keeping the slip from prematurely releasing and setting. More particularly, the circumferentially spaced fingers or slats 214 extending downward from the upper collar body each have a collet head 215 which fits within groove 213 in mandrel 104, and is prevented from moving axially by the upper sleeve portion of piston 216. The tieback pickup ring 212 also keeps the tieback from moving down when the liner is picked up for any reason, since if the tieback were to move down it could set the packer. As long as the slip releasing piston 216 does not move upward to unlock the locking collar 220, the slip 126 cannot release. FIG. 2 also shows a debris cover 222 to prevent relatively large objects and debris from traveling down the hole and preventing the reliable operation of the slip releasing mechanism.

Figure 3:
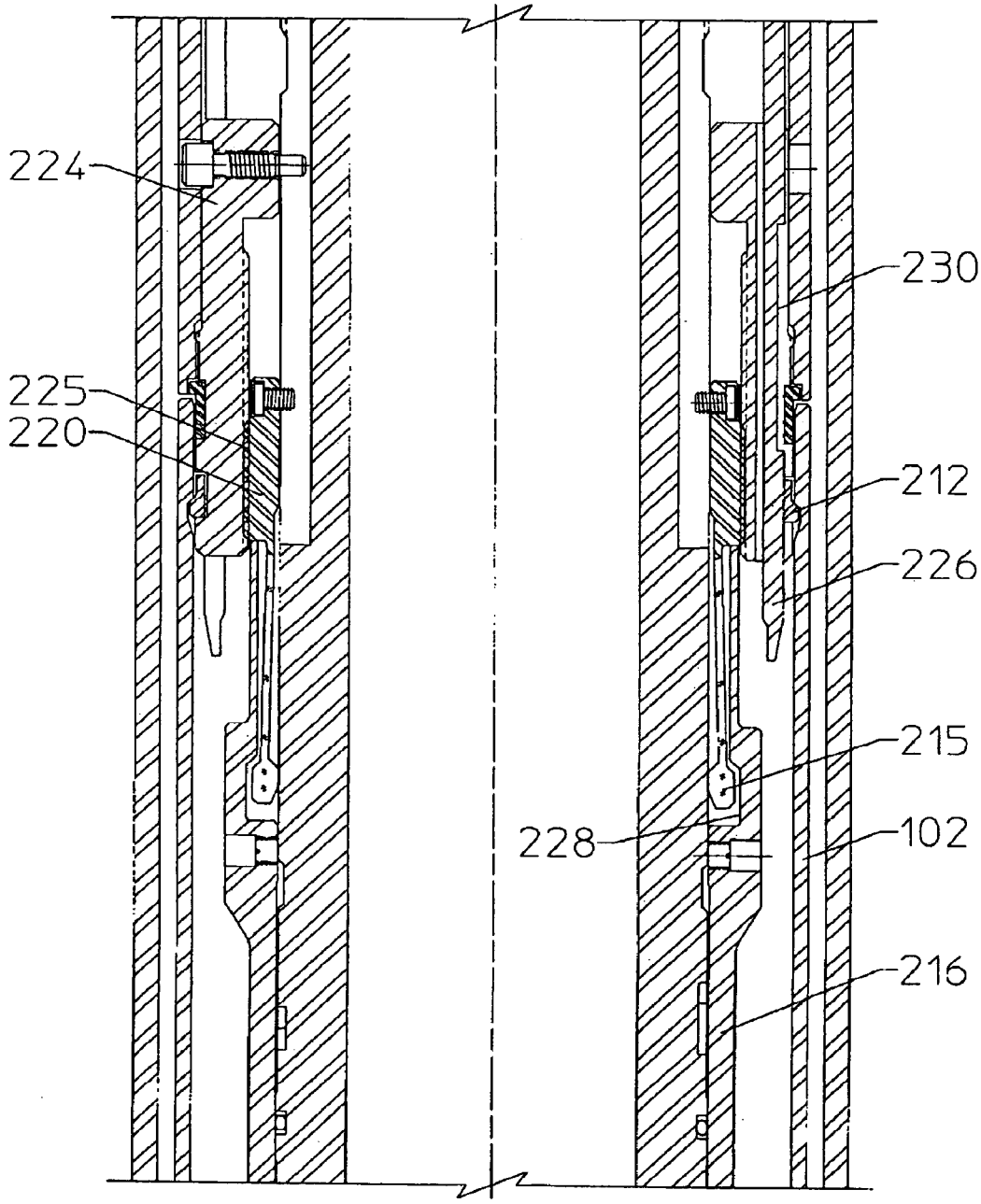
FIG. 3 illustrates the slip releasing mechanism shown in FIG. 2 after a collar is lowered to open a hydraulic port and raise a piston to disengage a locking collar.
Figure 4:
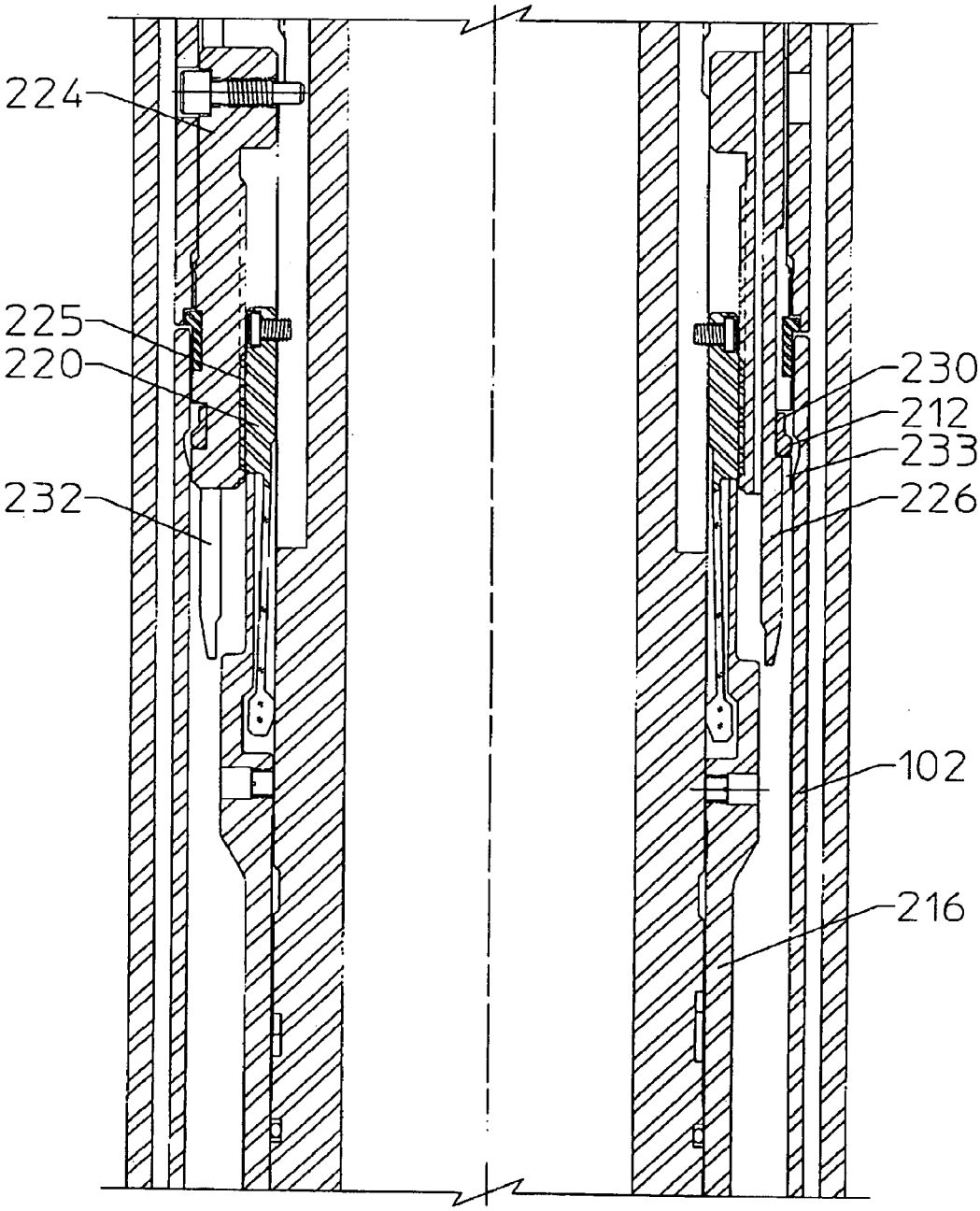
FIG. 4 shows the slip releasing mechanism piston further raised to release a tieback pickup ring.

The ball seat 116 and sleeve 112 move axially down after a ball lands on the seat 116, thereby exposing hydraulic ports 166 to the slip releasing piston 216. The slip releasing piston 216 thus is moved up in response to pressure within the mandrel, letting the collar 220 and collet heads unlock and move up to allow the slip to move up and release from the mandrel. Once the collet heads 215 enter the groove 228 in the slip releasing piston 216 (see FIG. 3), the locking collar 220 is unlocked and may continue to move upward with the slip releasing piston. FIG. 4 illustrates the slip releasing piston 216 moved upward to engage an end surface of the collar 220 and pull up on the slip 126, thereby allowing the slip to expand into engagement with the casing or other downhole tubular.

The locking collar 220 thus keeps the tieback 102 from moving up and prematurely releasing the slip 126. The tieback 102 may be threaded to a pusher sleeve which is attached to the cone 128, which in turn is attached to the tie bars 117 which pull on and release the slip from the pocket 119, so that the slip may thereafter move radially outward and set. As the slip releasing piston 216 moves up after engaging collar 220, it pushes the tieback pickup ring 212 up, since C-ring 212 is supported on a lower end of tieback pickup ring adjustment nut 224, which is threaded at 225 to the collar 220. As the slip releasing piston 216 moves up with the C-ring 212, the pickup ring moves into a groove 230 in the releasing sleeve 226, releasing from the tieback 102, thus releasing the retrievable portion of the tool from the anchored portion of the tool. During movement of the piston 216, the tieback pickup ring releasing sleeve 226 remains stationary with the mandrel 104. The tieback pickup ring 212, which acts as a releasing device, in turn pushes up the tieback 102 to release the slip. Once the locking collar 220 is disengaged, the tieback 102 may move axially to release the slip. For these applications, the slip or slips, once released, may be set by applying a substantial weight to the tool to set the slip.

A releasing ring adjustment nut 231 (see FIG. 5) is threaded to the mandrel 104, so that the releasing sleeve is axially moveable at the surface then made stationary with the mandrel. Tieback pickup ring adjustment nut 224 is similarly threaded to attach to the collar 220, which is axially moveable with the piston 216 once released. This allows the collar and the tieback pickup ring adjustment nut move up in response to movement of the slip releasing piston 216 to release the slip.

Figure 5:
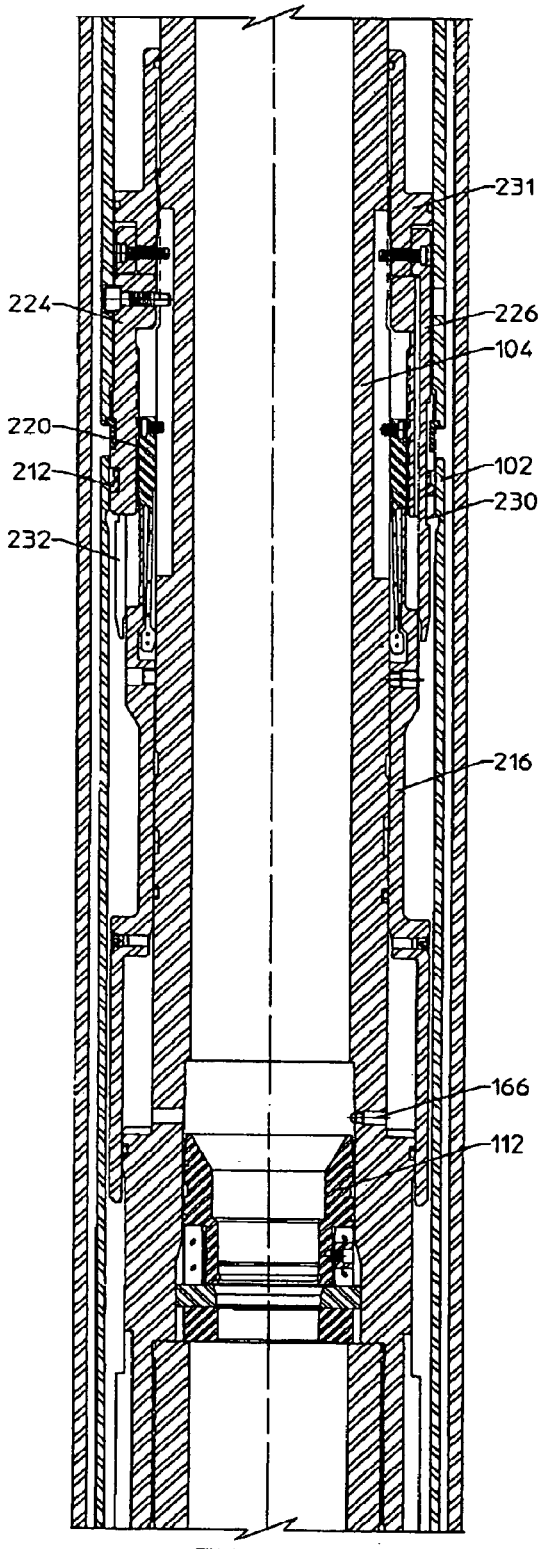
FIG. 5 shows the slip releasing piston fully stroked to release the downhole portion of the tool anchored to the tieback from the retrievable portion of the tool.
Figure 6:
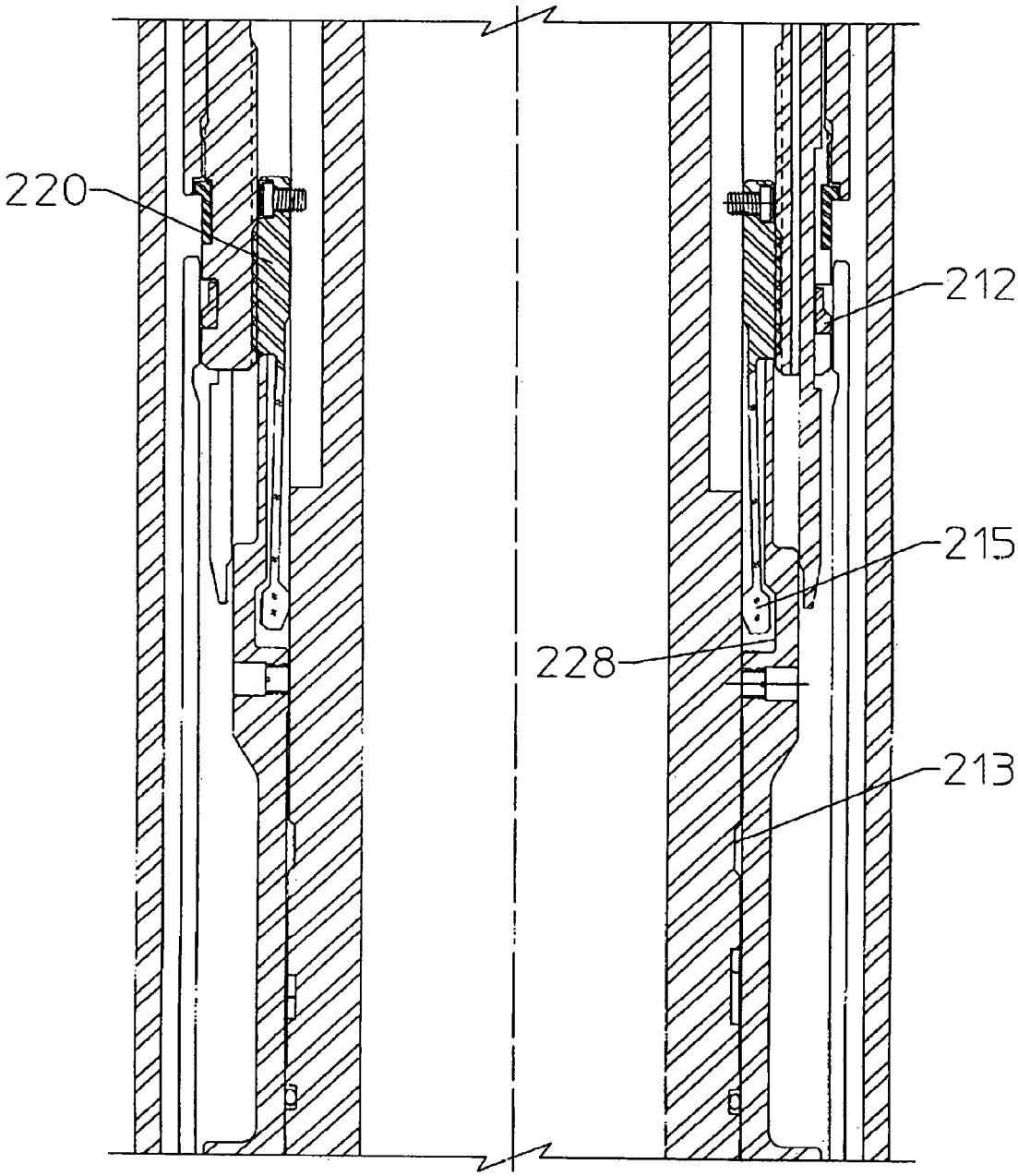
FIG. 6 is a cross-sectional view showing the connection between the adjustable nut sleeve and the tieback pickup ring which causes the tieback pickup ring to move upward during further movement of the piston.

FIG. 5 shows the tieback pickup ring 212 released, which is accomplished by further upward movement of the slip releasing piston 216, as explained above. As the slip releasing piston continues to move up, it pushes on the collar 220 and the adjustment nut 224. The adjustment nut 224 engages the tieback releasing ring 226, so that as the tieback pickup ring moves up, it will snap into a groove 230 on the tieback pickup ring releasing sleeve 226. Releasing sleeve 226 includes downward extending and circumferentially spaced slats or fingers 232. FIG. 5 shows the slip releasing piston fully stroked, and the tieback pickup ring fully disengaged.

FIG. 4 illustrates the adjustment nut 224, which includes axial extending slots 233 for receiving one of the circumferentially spaced slats or fingers 232 of the releasing sleeve 226 therein, and a plurality of circumferentially spaced grooves 230 for receiving the C-shaped releasing ring 212 therein. During run in of the tool, C-ring 212 is prevented from collapsing due to engagement with the exterior surface of the lower end of the releasing sleeve slats 232. When the tieback and the tieback pickup ring are moved upward with the adjustment nut by the piston 216, normally collapsed C-ring 212 automatically retracts inward to release the tieback 102, and thereby release the anchored portion of the running tool from the portion to be retrieved to the surface.

Those skilled in the art will appreciate that the running tool incorporates a locking device to keep the slip from releasing and prematurely setting while tripping into the wellbore. Fluid pressure within the drill string, rotation of the drill string, or axial forces exerted on the drill string will not inadvertently release the slip. The locking collar 220 and C-ring 212 keep the slip 126 locked in its run in position. Only after the ball is dropped and lands on the ball seat so that the hydraulic port 166 is opened can fluid pressure be applied to push the slip releasing piston up. As the piston moves up, it unlocks a locking collar 220. Further upward movement of the piston 216 releases the slip 126 and still further movement disengages the tieback pickup ring 212, which unlocks the retrievable running portion of the tool from the slip release piston and related components.

Travel of the piston 216 will push up on the tieback pickup ring 212, which picks up the tieback, which in turn picks up the tie bars which pick up the slip 126 to release the slip. Continued upward movement of a slip releasing piston will unlock the pickup ring 212 from the tieback 102, thereby unlocking the tieback from the running tool. The slip is thereby released and set, and the slip releasing assembly is disengaged from the liner hanger.

If the slips are circumferentially spaced, the reaction of the slip moving up the cone creates hoop loading to cause lower and more uniform stress in the casing and liner hanger. The loads are transferred circumferentially, rather than radially inwardly, thereby preventing hanger collapse and burst of the casing. The upper end of each slip may be connected to the lower end of a tie bar which extends slidably through the downwardly and inwardly tapered cone for the slip.

In an alternative slip assembly, the slip assembly may include a ring disposed about the slip cone in which there is a recess beneath the cone taper. The recess receives and retains the lower end of the slip when in its contracted position. However, as the slip is pulled upwardly by raising of the tie bar or slat, the lower end of the slip is pulled out of the recess and the slip is permitted to expand outwardly against the casing.

If the slip is a C-shaped slip, it has the ability to contract and expand between a contracted run-in position, and its extended or maximum expansion position. This maximum expansion position preferably is the as-fabricated or as-machined position for the slip. Thus, the slip may be designed so as to approach this expanded position as the slips expand outwardly into engagement with the casing.

Those skilled in the art will appreciate that the slip releasing mechanism as disclosed herein may release a single slip which is set to anchor the tool in the downhole tubular, or may release a plurality of axially spaced and/or circumferentially spaced slips to similarly set the tool in the downhole tubular. Also, the releasing mechanism could be employed to release other components of the downhole tool which are moved radially outward to engage the downhole tubular, such as a packer, although premature setting of a downhole tool slip is a more significant problem than premature setting of a packer, since a prematurely set packer may not prevent axial movement of the downhole tool.

The techniques of the present invention are particularly well suited for preventing the premature release of slips and the desired reliable setting of slips for a downhole liner hanger, but may also be used to prevent premature setting or releasing of downhole packers, downhole valves, multilateral tools, and other downhole tools.

As disclosed herein, the hydraulic ports are opened in response to a ball landing on a seat, which then shifts the ball seat downward to expose the ports. Various types of closure devices other than balls may be used for this purpose, including plugs. If used, the ball may be either deformable or the seat may be radially expanded to allow the ball to ultimately pass through the seat. Hydraulic pressure above the closed seat may be used to move the releasing piston upward, but in other embodiments the downhole tool components could be arranged so that the high pressure above the closed seat passes through the hydraulic port to push the piston downward, which then causes the release of the lock. In still other embodiments, a pair of axially spaced plugs or valves may be positioned along the bore of the mandrel, and pressurized gas released within the bore to pass through the hydraulic port and actuate the piston.

In a preferred embodiment, the same piston is used to move axially to unlock the locking member, and continues to move axially to move the releasing ring and the tieback axially, and finally releases the releasing ring from the tieback when the slip is set. In other embodiments, more than one piston could be used for achieving these purposes. It should be understood that the increase in pressure above the seated ball may accomplish each of these tasks in a successive and fairly short timeframe. Alternatively, pressure levels could be increased above the seated ball so that, for example, a first pressure is used to unlock the locking member, and a second higher pressure is then used to move the releasing ring and tieback upward, then if desired, a still higher pressure used to mechanically separate the tieback from the retrievable portion of the tool.

As disclosed herein, a collet mechanism is used to lock and subsequently release of the slips once the piston has moved axially upward in the disclosed embodiment. In other embodiments, the function served by the collet mechanism to unlock the slips could be accomplished with a C-ring, which similarly fits within a groove to lock the locking collar to the mandrel until the groove in the piston is aligned with the C-ring to release the collar from the mandrel. Also, a C-ring preferably is used to release the tieback from the portion of the running tool to be retrieved, although a collet mechanism could be used rather than a C-ring for this purpose.

While preferred embodiments of the present invention have been illustrated in detail, it is apparent that modification and adaptations of the preferred embodiments will occur to those skilled in the art. However, it is to be expressly understood that such modifications and adaptations are within the spirit and scope of the present invention as set forth in the following claims.

What is claimed is:

1. A running tool for releasing a slip to secure a body to be supported in a well by the slip and for preventing the premature actuation of the slip, the running tool and work string retrievable from the well while the slip remains in the well, comprising:

the slip run in the well in a radially retracted position and released downhole by the running tool to a radially expanded position to engage a downhole tubular, and thereafter is set to grip the downhole tubular;

a tool mandrel having a port providing fluid communication between a running string in fluid communication with an interior of the mandrel and an actuating piston;

a blocking member for closing off the port when the tool is run in the well, and for selectively opening the port to set the slip;

a slip releasing member radially outward of the mandrel and axially movable relative to the mandrel to release the slip;

a locking member for preventing axial movement of the slip releasing member and thereby preventing premature releasing of the slip, the locking member being axially securable relative to the mandrel when the running tool is run in the well; and the actuating piston moveable with respect to the tool mandrel when the port is opened to move the locking member and release the slip prior to setting in the well.

2. A running tool as defined in claim 1, further comprising:

the actuating piston engaging the locking member and moving the locking member axially relative to the mandrel to release the slip.

3. A running tool as defined in claim 1, further comprising:

a connecting ring for axially securing the running tool to the supported body; and the actuating piston moving one of the locking ring and a recess relative to the other of the locking ring and the recess to release the running tool from the supported body.

4. A running tool as defined in claim 3, wherein the connecting ring is moved by the actuating piston relative to a groove to disengage the running tool from the supported body and prevent premature release of the slip.

5. A running tool as defined in claim 1, wherein the locking member includes a locking collar with a plurality of circumferentially secured collet heads to lock the locking member to the mandrel.

6. A running tool as defined in claim 1, wherein a locking collar radially exterior of the tool mandrel axially secured to the locking member is axially moveable in response to the piston.

7. A running tool as defined in claim 6, wherein a releasing device is axially moved by further movement of the piston to disengage the running tool from the supported body, and the piston engages the locking collar to axially move the locking collar and the releasing device.

8. A running tool as defined in claim 7, wherein an axial interconnection between the locking collar and releasing device is through a releasing device adjustment nut axially secured to the locking collar and selectively moveable at the surface to position the releasing device relative to the supported body.

9. A running tool as defined in claim 8, wherein the releasing device is a C-ring positioned within a groove in the supported body when the running tool and the body are run in the well, and collapses into a groove to release the running tool from the supported body.

10. A running tool as defined in claim 9, further comprising:

a releasing sleeve secured to the releasing device adjustment nut and axially fixed relative to the mandrel, the releasing sleeve including a groove to receive the collapsed C-ring.

11. A running tool as defined in claim 1, further comprising:

a locking device adjustment nut selectively moveable at the surface to position the locking member within a groove in the actuating piston.

12. A running tool as defined in claim 1, wherein the locking member includes circumferentially spaced collet fingers each having a collet head at one end thereof.

13. A running tool for locking a slip in a reduced diameter position when running the tool into the well and for selectively releasing the slip to move radially outward to a released position for suspending a body supported by the slip in the well, the running tool and work string retrievable from the well while the slip remains in the well, comprising:

the slip run in the well in a radially retracted position and released downhole by the running tool to a radially expanded position to engage a downhole tubular, and is thereafter set to grip the downhole tubular;

a mandrel having a through passage for fluid communication with an interior of a running string;

a slip releasing member radially outward of the mandrel and axially movable relative to the mandrel to release the slip;

a locking member preventing the slip releasing member from moving axially relative to the mandrel for retaining the slip in a reduced diameter position when the tool is run in the well;

a hydraulic port in the mandrel that is closed to mandrel internal pressure when the downhole tool is run in the well and is selectively opened to release the slip;

an actuating piston moveable in response to mandrel internal pressure applied through the hydraulic port to unlock the locking member; and further movement of the actuating piston releases the slip from the reduced diameter position the radially expanded position prior to setting the slip in the well.

14. A running tool as defined in claim 13, wherein further movement of the actuating piston moves one of a locking ring and a groove relative to the other of the locking ring and the groove to disengage the running tool from the supported body.

15. A running tool as defined in claim 14, wherein the locking ring is moved by the actuating piston relative to a groove to disengage the running tool from the supported body.

16. A running tool as defined in claim 15, further comprising:

a locking ring adjustment nut threaded to the locking member.

17. A running tool as defined in claim 15, wherein the locking member includes a collar with a plurality of circumferentially secured collet heads to lock the locking member to the mandrel.

18. A method of locking a slip of a downhole tool in a reduced diameter position when running the tool into a well bore and selectively releasing the slip to move radially outward to a released position and support a body within a tubular in the well bore, the running tool and work string retrieved from the well while the slip remains in the well comprising:

providing a mandrel having a through passage;

providing a slip releasing member radially outward of the mandrel and axially movable relative to the mandrel to release the slip;

providing a locking device axially connecting the slip releasing member to the mandrel for retaining the slip in the reducing diameter position while running the tool into the well bore;

retaining a hydraulic port closed within the mandrel as the tool is run into the wellbore and selectively opening the hydraulic port when the tool is to be set;

running the slip in the well in a radially retracted position; and moving a piston in response to mandrel internal pressure applied through the hydraulic port to unlock the locking device and release the slip from the reduced diameter position to an expanded position.

19. A method as defined in claim 18, further comprising:

disengaging the retrievable portion of the tool from the supported body in response to piston movement.

20. A method as defined in claim 19, wherein a releasing member contracts into a groove axially secured to the mandrel to release the retrievable portion of the tool from the supported body.

21. A method as defined in claim 20, further comprising:

axially securing a releasing sleeve to the mandrel, the releasing sleeve including a recess for receiving the releasing member when in the collapsed position.

22. A downhole tool as defined in claim 18, wherein providing a locking device comprises:

axially securing a locking member within a groove in the mandrel to prevent axial movement of the locking member prior to axial movement of the piston; and providing an unlocking groove in the piston to receive a portion of the locking device in response to axial movement of the piston.

23. A method as defined in claim 18, further comprising:

providing a locking device adjustment nut selectively moveable at the surface relative to the mandrel to position the locking device within the groove in the piston.

24. A method as defined in claim 21, further comprising:

providing an adjustable nut for adjusting the axial position of the release member relative to the recess in the supporting body.

* * * * *